US005685609A

United States Patent [19]

Miotto

[11] Patent Number: 5,685,609

[45] Date of Patent: Nov. 11, 1997

[54] MECHANISM TO ADJUST THE HEIGHT OF A BACK SUPPORT OF A CHAIR

[75] Inventor: Beniamino Miotto, Roncade, Italy

[73] Assignee: Miotto International Company, Green Bay, Wis.

[21] Appl. No.: 449,479

[22] Filed: May 30, 1995

[30] Foreign Application Priority Data

Mar. 21, 1995 [IT] Italy ..... TV950016 U

[51] Int. Cl.[6] ..... A47C 7/46

[52] U.S. Cl. ..... 297/353

[58] Field of Search ..... 248/118.3, 125.3, 248/297.21, 297.31, 407, 408; 297/353, 411.36

[56] References Cited

U.S. PATENT DOCUMENTS

| | | |
|---|---|---|
| 848,001 | 3/1907 | Berninghaus . |
| 3,309,050 | 3/1967 | Blink et al. . |
| 3,460,794 | 8/1969 | Colautti . |
| 3,526,430 | 9/1970 | Eldon, III . |
| 3,854,772 | 12/1974 | Abrahamson et al. . |
| 3,917,341 | 11/1975 | Albinson . |
| 4,012,158 | 3/1977 | Harper . |
| 4,015,878 | 4/1977 | Perkins . |
| 4,036,525 | 7/1977 | Howk . |
| 4,043,592 | 8/1977 | Fries . |
| 4,221,430 | 9/1980 | Frobose . |
| 4,384,742 | 5/1983 | Wisniewski . |
| 4,451,084 | 5/1984 | Seeley . |
| 4,466,665 | 8/1984 | Aronowitz et al. . |
| 4,616,877 | 10/1986 | Slaats et al. . |
| 4,639,039 | 1/1987 | Donovan . |
| 4,660,885 | 4/1987 | Suhr et al. . |
| 4,749,230 | 6/1988 | Tornero . |
| 4,786,108 | 11/1988 | Dauphin . |
| 4,930,840 | 6/1990 | Tornero . |
| 5,037,158 | 8/1991 | Crawford ..... 297/353 |
| 5,286,088 | 2/1994 | Taylor et al. . |
| 5,405,189 | 4/1995 | Stumpf . |

FOREIGN PATENT DOCUMENTS

| | | |
|---|---|---|
| 81898 | 6/1983 | European Pat. Off. ..... 297/353 |

*Primary Examiner*—Michael Safavi

*Attorney, Agent, or Firm*—Andrus, Sceales, Starke & Sawall

[57] ABSTRACT

A mechanism for adjusting the height of a back relative to a seat in a seating assembly having a support member interconnecting the seat and the back. A recess is formed in an upright portion of the support member, and a toothed rack is secured within the recess. The upright portion of the support member is slidably engageable with a box-like unit secured to the back, and an engagement member is mounted to the box-like unit and disposed within the recess formed in the support member upright portion. The engagement member includes engagement structure selectively engageable with certain of the rack teeth to fix the position of the back relative to the support member. A biasing element urges the engagement member to an engagement position in which the engagement structure is engaged with certain of the one or more teeth. The biasing element also functions to retain the engagement member in a disengaged position when the back is fully raised, for enabling the back to be lowered without engagement of the engagement structure with the rack teeth. Release structure is engageable with the engagement member when the back is fully lowered so as to disengage the engagement member from the biasing element in preparation for subsequent positioning of the back by raising the back relative to the seat.

17 Claims, 6 Drawing Sheets

MECHANISM TO ADJUST THE HEIGHT OF A BACK SUPPORT OF A CHAIR

BACKGROUND AND SUMMARY

The object of this application is a mechanism for adjusting the tilt of a chair back via its support bracket extending behind and above the seat.

A slot for a rack, which provides primary and secondary projections for selectively engaging or temporarily disengaging a pin, is created by blanking the aforementioned bracket, which slides inside a box unit attached to the chair back with a curved cleat.

The pin, by pressing against a flexible part connected to the box unit, allows a person to vary the tilt of the chair back as desired.

The object of this application is a mechanism for adjusting the tilt of a chair back via its support bracket extending behind and above a seat.

Today a latching system is used to adjust chair backs. This latching system operates in tandem with a support bracket extending above the seat and consists of a knob screwed into the rear of the seat with a threaded shank inserted in an appropriately counter-threaded slot; rotation of the knob causes the lower end of the shank to engage in the base of the support bracket extending above the chair itself.

This solution has some drawbacks, for example by imposing a multi-step activation sequence, a result of the fact that locking the chair back requires the user first to position the back by loosening the knob, and then to block it by locking the knob itself.

Furthermore, if the user is seated, he must contort himself in order to carry out this operation, otherwise he has to get up to do so, which is a less than optimal solution.

Another drawback to this solution is that the seat encounters, where the knob shank comes into contact with the bracket, rotational resistance that loosens the grip and forces the user to continually adjust the position of the chair back.

Another solution is found in U.S. Pat. 4,749,230, wherein is illustrated an adjustment mechanism for the manual adjustment and automatic locking of the tilt of a seat back with respect to the position of the seat.

The device consists of two guided plates that slide along in tandem, connected to gripping mechanisms.

These plates consist of a sliding plate rigidly connected to a support bracket extending from the seat, and guide plate connected to the seat back so as to allow the movement of the sliding plate between its two extreme positions by means of the aforementioned blocking mechanisms.

The sliding plate consists of an "S" shaped base in plan, terminating in two cams at its ends, so configured as to allow a peg to slide along them.

The guide plate exhibits a longitudinal slot which contains a number of rounded teeth along one side that define a rack.

Engagement of the peg in the aforementioned rack permits movement by the guide plate in one direction, towards the upright position of the connected seat back.

However, this mechanism has some drawbacks, and among these, mention must be made of a problem encountered during adjustment of the seat back: in order to raise the back, one must first tilt it forward until the peg advances at least one tooth down in the rack and then tilt the back down again so that the peg itself is blocked between two teeth in the rack.

On the contrary, in order to lower the back after setting it in the previous position, the back must first be raised completely and then completely lowered so as then to be able to raise it again to the desired position, all the while carrying out the actions necessary to adjust it.

Thus, this mechanism permits upward adjustments which, so that one may determine the correct position, require the back to be tilted back and forth continuously, with the possibility of avoiding selection of an undesired position.

A further disadvantage stems from the fact that sliding problems can arise: the guide plate is in fact connected to a seat back surface that is usually curved, and this can lead to deformation of the cam slot, compromising the sliding motion and blockage of the peg in the rack.

Another drawback stems from the fact that the least a seat can be adjusted is a distance equal to that between two teeth in the rack, thus leading to a less than optimal adjustment; the peg has distinct blockage points, the distance between which depends on the teeth requiring a certain spacing so as not to weaken the structure.

Furthermore, the peg is free to move inside the S-shaped cam during the time required to raise the back completely. This can lead to accidental engagement of the peg at an undesired intermediate point in the rack since the peg tends to slip downwards inside the branch of the cam turned towards the rack when the back is slightly tilted, which can be caused accidentally by the user; in this case it would be necessary to lower the back completely in order to raise it back up again.

The sliding plate is connected to the support bracket by screws, which naturally require prior drilling of holes, thus increasing overall production costs.

The principal object of the present finding is to resolve the highlighted technical problems by eliminating the drawbacks cited in the technical note and devising a mechanism that permits the user to perform very precise adjustments of the seat back quickly and easily.

Within the scope of the aim stated above is another goal, that of creating a mechanism which allows even very slight adjustments in the position of the seat back so as to permit each user to place the seat back in the best position with respect to his or her own physical profile.

An important goal is to create a mechanism that provides for adjustable positions while avoiding accidental and undesired settings that entail moving the seat back continuously back and forth.

Another goal is to create an easy-to-use mechanism that can be activated directly by the user through direct movement of the seat back itself.

Another goal is to create a mechanism that involves low costs in relation to the utilized components.

Another, but not final, goal is to devise a mechanism that can be made with ordinary and familiar machines and facilities.

These and other goals, which will appear more clearly below, are achieved by a mechanism for adjusting the tilt of a chair back via its a support bracket extending behind and above the seat. This bracket is distinguished by its slot for a rack, which provides primary and secondary projections for selectively engaging or temporarily disengaging a pin, and which is created by blanking the aforementioned bracket, which slides inside a box unit attached to the chair back with a curved cleat, and where the pin presses against a flexible part connected to the box unit.

BRIEF DESCRIPTION OF THE DRAWINGS

Other characteristics and advantages will be revealed more fully in the detailed description of the mechanism according to the finding, illustrated for explanatory purposes in the attached drawing, in which.

DETAILED DESCRIPTION

Figure 1:
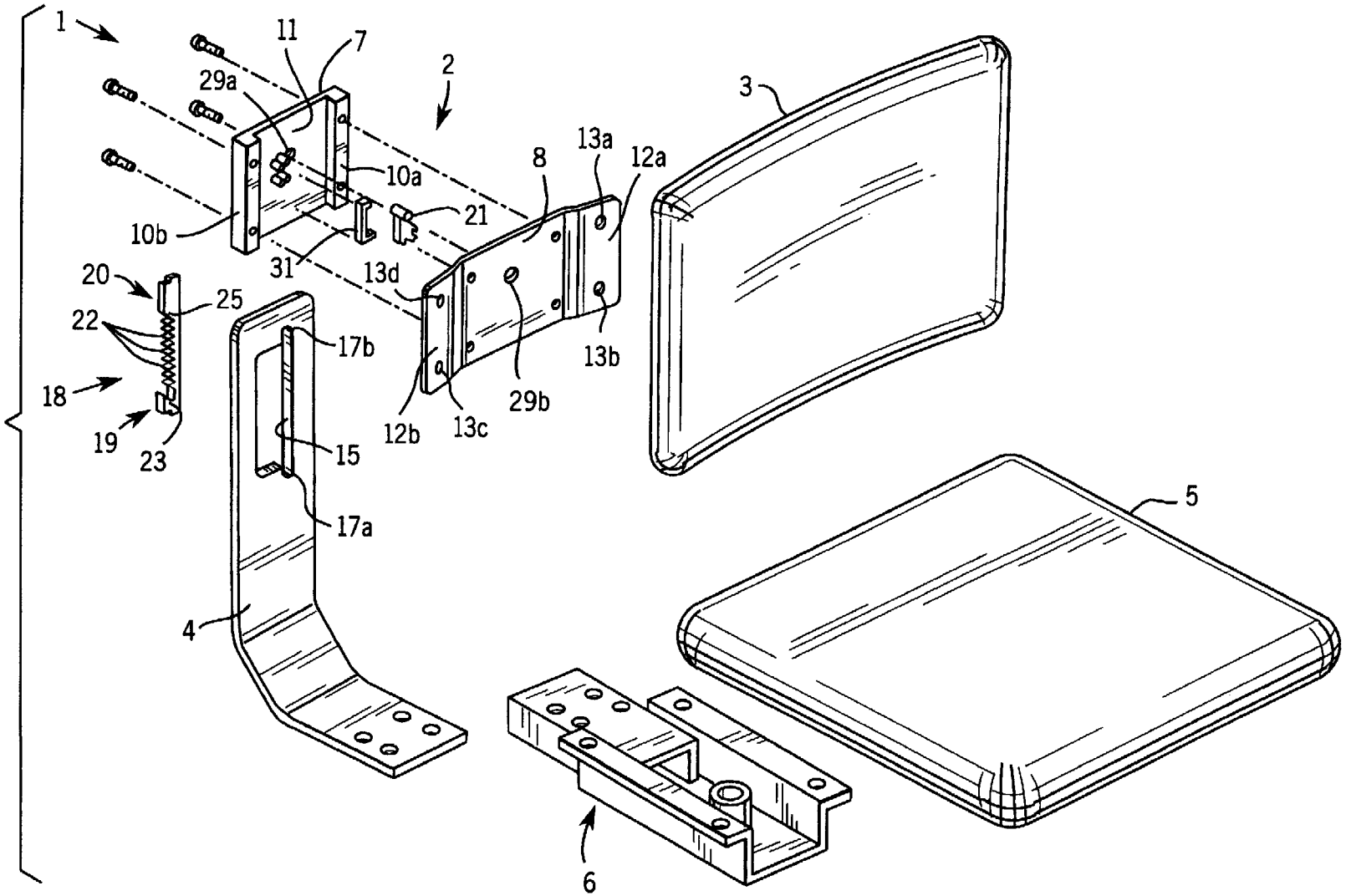
FIG. 1 shows a mechanism attached to a chair, in three-quarter exploded view.
Figure 2:
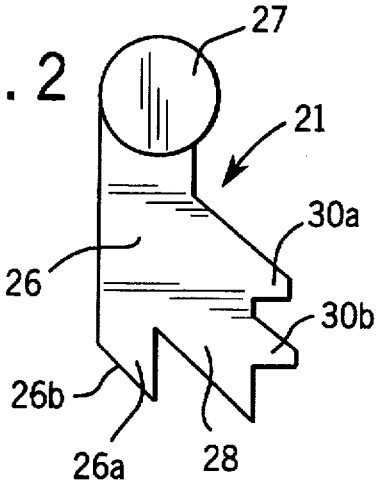
FIG. 2 shows the pin, frontal view.
Figure 3:
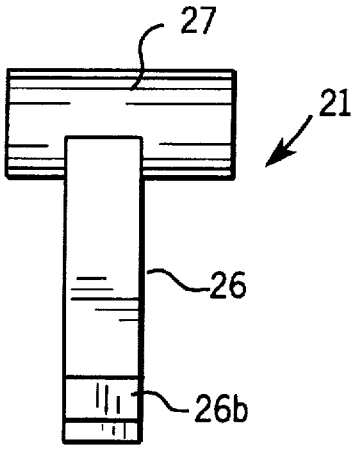
FIG. 3 shows the pin shown in FIG. 2, side view.
Figure 4:
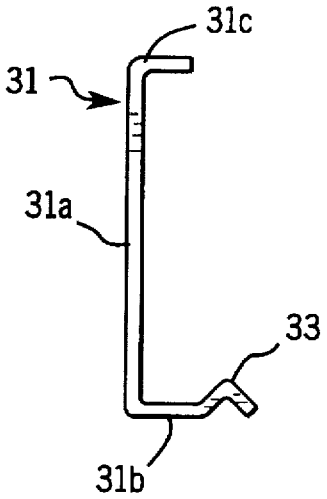
FIG. 4 shows the flexible part, frontal view.
Figure 5:
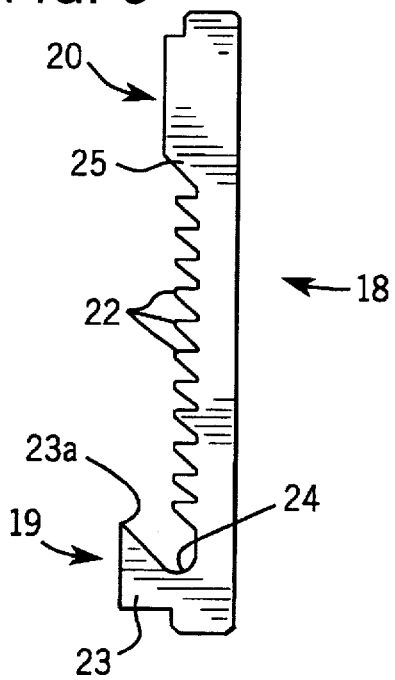
FIG. 5 shows the rack, frontal view.
Figure 6:
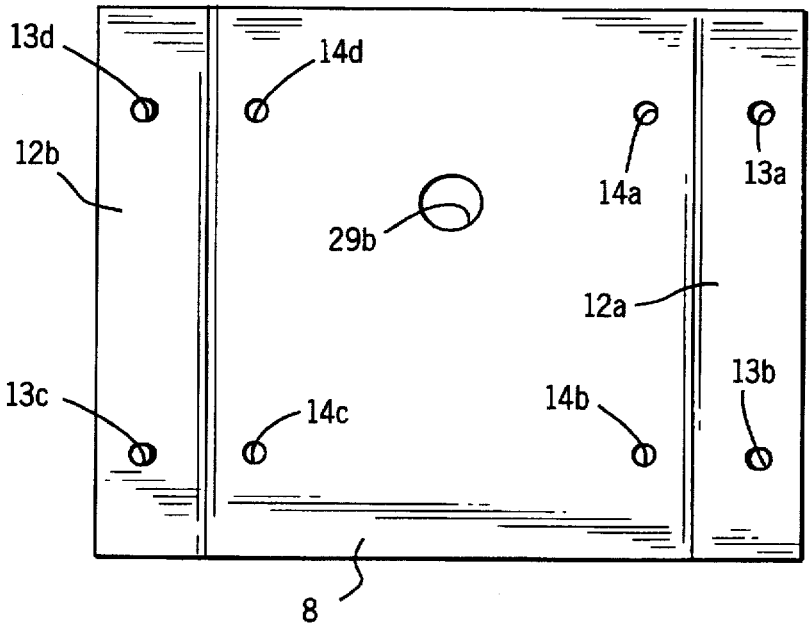
FIG. 6 shows the curved cleat, partially reduced frontal view.
Figure 7:
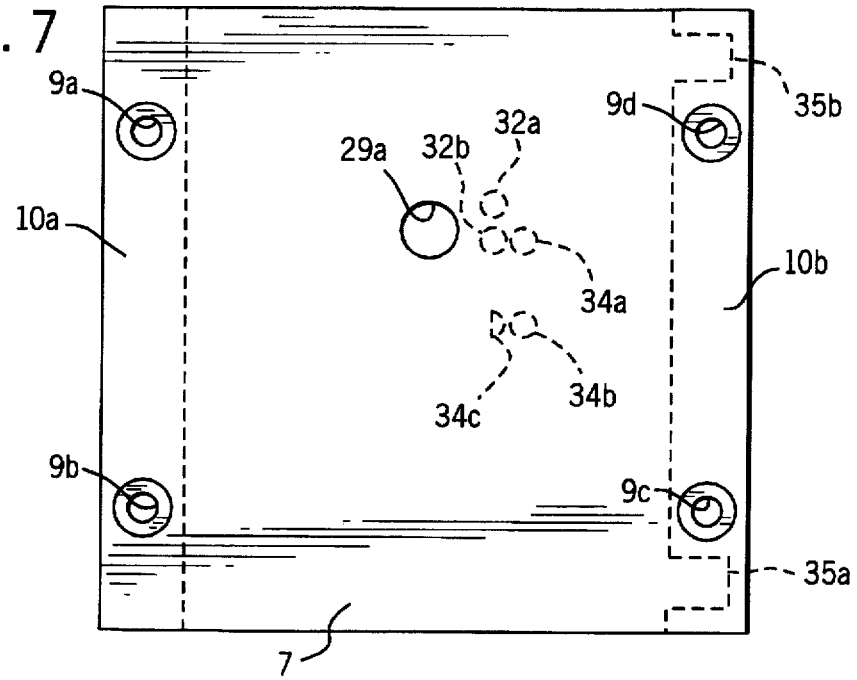
FIG. 7 shows the box unit, rear view.
Figure 8:
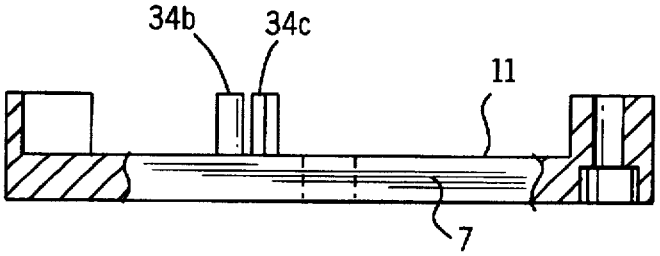
FIG. 8 shows the box unit of the previous figure; partial section lateral view.
Figure 9:
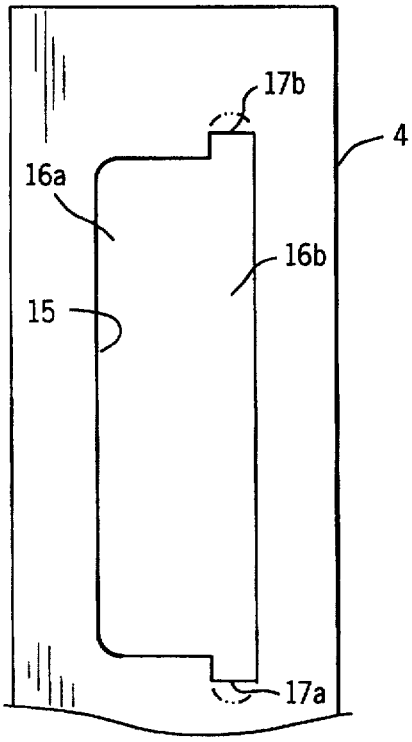
FIG. 9 partially shows the support bracket, frontal view.
Figure 10:
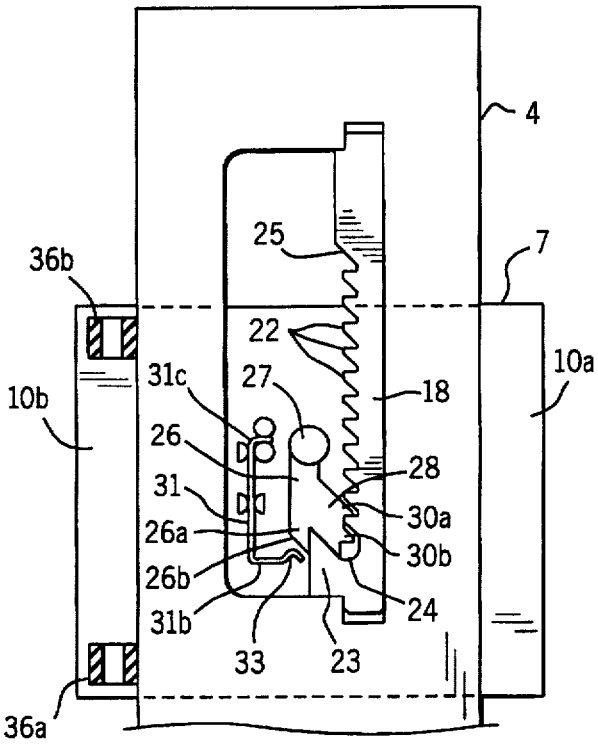
FIGS. 10, 11, 12, 13, and 14 partially show, in a front view, the mechanism with the pin while engaged and disengaged from the rack, and in these figures the curved cleat is omitted for greater clarity.
Figure 11:
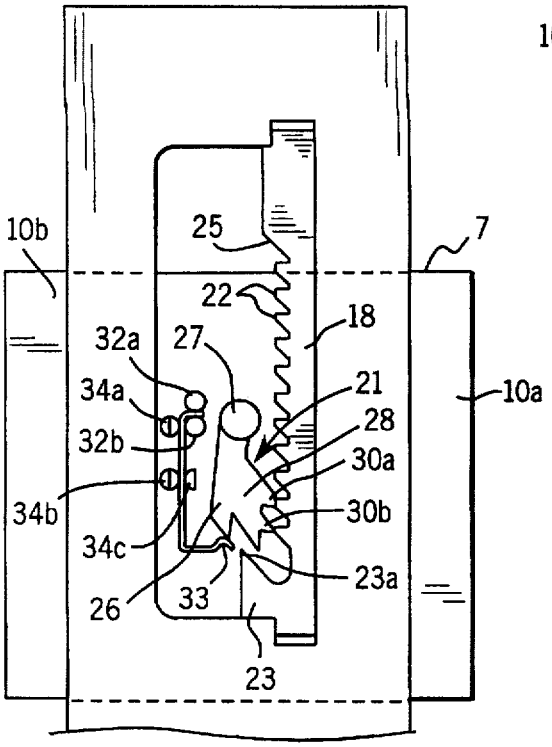
Figure 12:
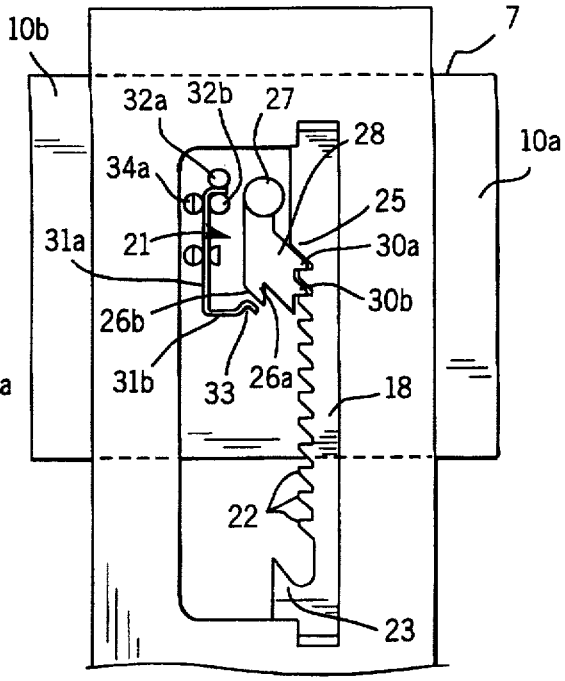
Figure 13:
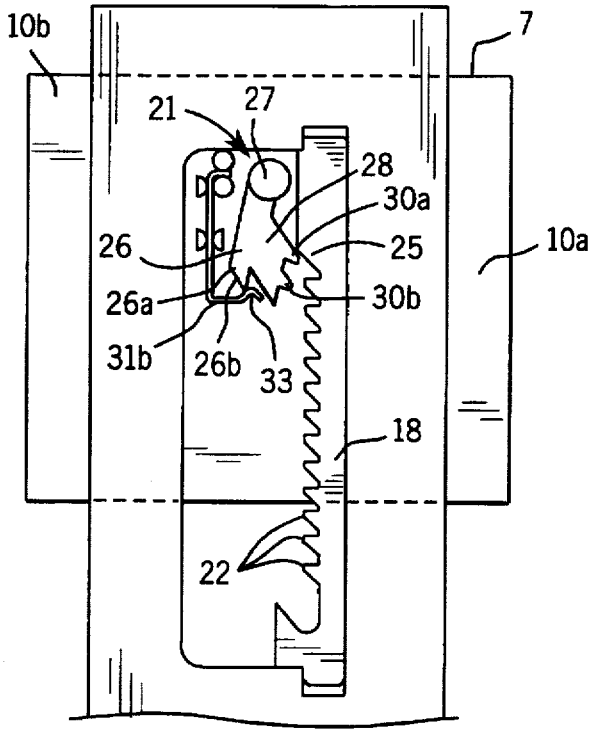
Figure 14:
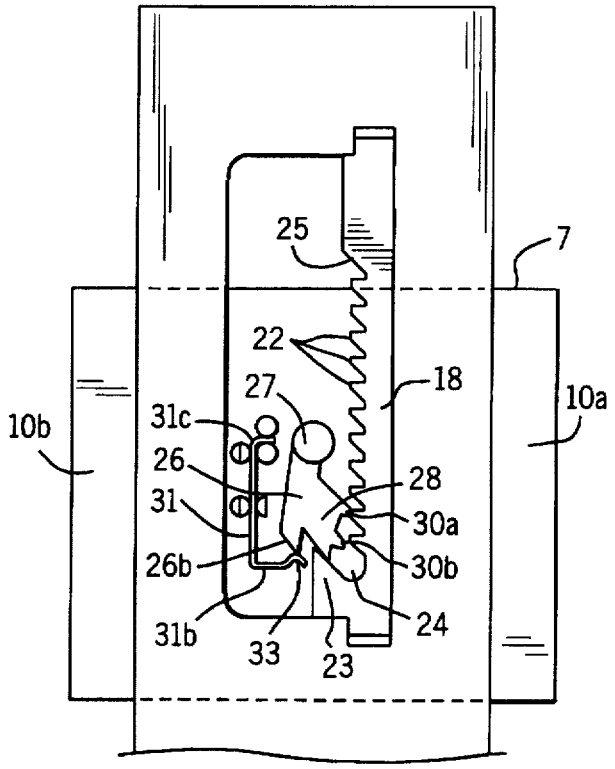

Regarding the figures mentioned above, the adjustment mechanism is indicated by number 1 and includes a box unit 2, attached at the rear to a seat back 3, into which support bracket 4 can be inserted and attached by sliding it in, and it extends behind and above a seat 5, being attached to the bottom of it with a common type of coupling device 6.

The box unit 2 includes bracket 7 with a first set of four holes numbered 9*a*, 9*b*, 9*c*, and 9*d*, and a cleat 8 which is curved and attached to this bracket.

Bracket 7 has two lateral ridges, 10*a* and 10*b*, parallel to each other and protruding from the bracket. During engagement with curved cleat 8, they create a primary sliding base 11, shaped to mate with the support bracket 4.

The curved cleat 8 has two wings, 12*a* and 12*b*, which protrude laterally on opposite sides and contain, respectively, a second pair of holes, 13*a* and 13*b*, and a third pair 13cand 13*d* ; these allow the curved cleat 8 to be attached to the seat back 3. Cleat 8 also has a fourth set of four holes, indicated as 14*a*, 14*b*, 14*c*, and 14*d* and aligned along the same axes as the first set of holes, so that it may be attached to bracket 7 with screws.

A second, essentially T-shaped slot 15 is made in support bracket 4 by blanking, defined by a first, longitudinal slot 16*a* and, laterally, by a second slot 16*b*, which is substantially longer than the first. At both ends of the second slot 16*b*, there are two notches, 17*a* and 17*b*, which form a slot for attaching rack 18.

Rack 18 has, close to the first notch 17*a*, release structure in the form of a projection 19 for selective engagement of a pin 21, centrally attached to the primary sliding base 11. Close to the second notch 17*b* is actuator structure in the form of a projection 20 for the temporary disengagement of pin 21 itself. Rack 18 also contains, between projection 19 and projection 20, numerous teeth 22, which are trapezoidal or triangular shape in section and oriented in the desired direction, such that the triangular shape of teeth 22 define disengagement structure for selectively disengaging pin 21 from teeth 22, in a manner to be explained.

Projection 19 consists of a tab 23, triangular in shape and protruding from rack 18, with point 23*a* connected with slot 15. The tab 23 provides, together with the lower end of rack 18, a third support slot 24 for the end of pin 21.

Projection 20, for temporary disengagement, is formed by a second tab 25, which projects over the section of rack 18 containing teeth 22; pin 21 strikes against this and thereby disengages, as will be described further on.

Pin 21, which is essentially T-shaped, consists of a main central part 26; a second, cylindrical piece 27, solid or hollow, is transversely connected to its upper end; a third piece 28 is attached to its side at an The two extremities of the second, cylindrical piece 27 are inserted in a fifth hole 29*a*, bored through the center of bracket 7, and in a sixth hole 29*b*, bored on the same axis as the fifth hole 29*a* on the curved cleat 8. In this way, the second, cylindrical piece 27 is hinged, allowing pin 21 to swing freely on the sliding base 11.

If pin 21 has a hollow cylindrical piece 27, the latter may connected to bracket 7 and cleat 8 by inserting a hinge pin through the fifth hole 29*a* and the sixth hole 29*b*.

The third side piece 28 on pin 21 is oriented along a direction at an acute angle from the vertical, measured positively in a counter-clockwise direction.

At its free end, side piece 28 has a pair of second teeth 30*a* and 30*b*, cut to mate with the adjacent teeth 22 on rack 18.

At its lower end, the main central part 26 of pin 21 has a third tooth 26*a*, lying below the pair of teeth 30*a* and 30*b*, having a lower surface 26*b*, angled parallel to the direction of side piece 28.

Within the main sliding base 11 on bracket 7 is bias means in the form of a flexible part 31, comprised of a thin, essentially L-shaped plate to the side of pin 21, on the opposite side from piece 28, and interacting with rack 18.

Flexible part 31 consists of a longer arm 31*a* lined up parallel to the main central part 26 and a shorter arm 31*b* lined up perpendicular to the main part 26 and bent towards the third tooth 26*a*.

At the end of large arm 31a and facing the main part 26, flexible part 31 has a curved part 31*c* which can be inserted between two pegs, 32*a* and 32*b*, that project perpendicularly from sliding base 11 on bracket 7. Flexible part 31 has, at the end of short arm 31*b*, a projection 33 which can be engaged or engages with the lower surface 26*b* of the third tooth 26*a* such that projection 33 and lower surface 26*b* together define mating engagement or retaining structure for temporarily maintaining pin 21 in its disengaged position.

The longer arm 31*a* of flexible part 31 is set in a channel that can hold it rigid; this channel is comprised of the aforementioned pegs 32*a* and 32*b*, by a third peg 34*a*, which is placed next to the second peg 32*b*, and by a fourth and a fifth peg, 34*b* and 34*c*, which are placed lower than the last two but in alignment with them.

Insertion of flexible part 31 between these pegs allows it to make a rigid connection with bracket 7. Bracket 7 contains a pair of third slots 35*a* and 35*b*, transversely cut into lateral ridge 10*b* and situated between holes 9*c* and 9*d* and the outer side edges of bracket 7.

A pair of small tubes 36*a* and 36*b* can be inserted into slots 35*a* and 35*b*. They can be made from rubber or a similarly elastic material, arranged longitudinally along the bracket, and having a slightly larger diameter than the width of the slots themselves.

This pair of small tubes 36*a* and 36*b* creates friction when bracket 7 slides along fixed cleat 8.

The mechanism functions as follows: when the seat back is completely lowered side part 28 on pin 21 is at least partially inserted in support slot 24, and projection 33 remains set close to the lower surface 26*b* of the third tooth 26.

When seat back 3 is moved upwards, pin 21 slips in the direction of flexible part 31 on account of the mutual slippage between the pair of second teeth 30*a* and 30*b* and the first teeth 22. In the process, projection 33 strikes against lower surface 26*b* on third tooth 26*a*, forcing the pair of teeth 30*a* and 30*b* to engage again with teeth 22 on rack 18.

Because of the forced engagement of pin 21 on rack 18, it is possible to set various intermediate positions; these positions are secure when the user leans against the seat back because the mutual engagement of the pair of teeth 30*a* and 30*b* with rack teeth 22 prevents the seat back from tilting back.

When pin 21 reaches its maximum height, the end of side part 28 that is not adjacent to tooth 26*b* strikes against the second tab 25: the pair of teeth 30*a* and 30*b* thereby disengage from teeth 22 in rack 18 and projection 33 on the flexible part 31 securely blocks pin 21, catching in the notch between tooth 26*a* and the main central portion 26.

Pin 21 is thereby set in a temporarily disengaged position with respect to rack 18.

Then, seat back 3, and thus box unit 2, lowers by gravity until side part 28 catches against 23, forcing the disengagement of projection 33 from tooth 26*a*, thereby resetting pin 21 in its original position as described. During the entire lowering phase, the pair of small tubes 36*a* and 36*b* create a certain amount of friction between bracket 7 and cleat 8, thereby improving their sliding motion against each other.

It has thus been verified that the discovery as conceived above has fulfilled its task and realized its goals, given the invention of a mechanism which permits a person to adjust the height of a seat back easily and quickly, and which offers the possibility of choosing numerous, closely separated positions that make it possible to satisfy the needs of every user on the basis of his or her own physical profile.

Furthermore, when the seat back is being lowered, the presence of the flexible part, in addition to providing for optimal interaction between the pin and the rack teeth, blocks the pin by altering the catch point with the rack by keeping it disengaged from the rack itself; this prevents the pin from accidentally engaging with the first teeth on the rack and thus saves the user from having to carry out a series of tiring back-and-forth movements with the seat back in order to reach the desired position.

As for the parts that are used, this mechanism offers low fabrication costs.

Figure 15:
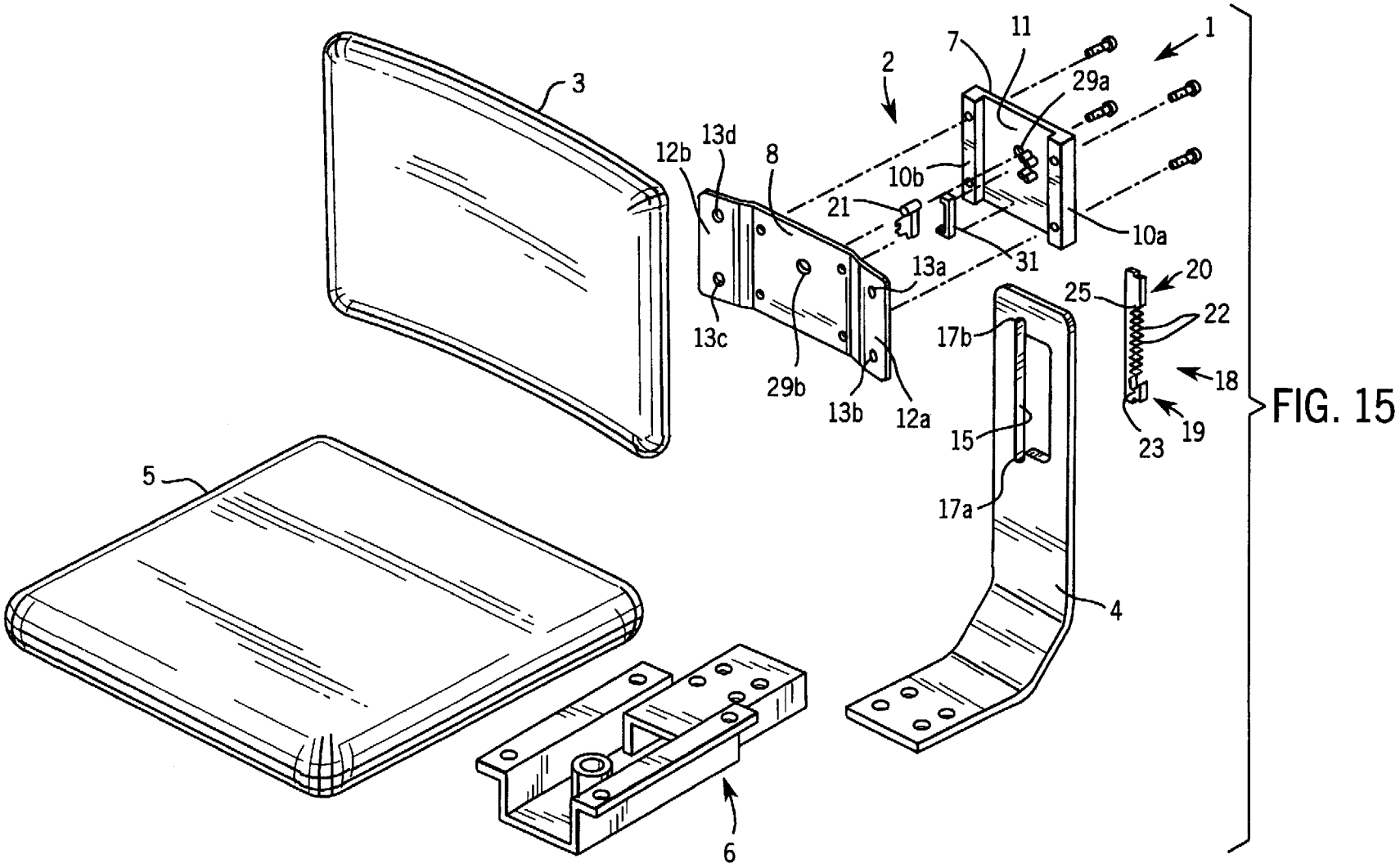
FIG. 15 shows, in three-quarter exploded view, the mechanism with the rack placed in a symmetrical position with respect to FIG. 1.

Naturally, as indicated in FIG. 15, the second slot 16*b* can be symmetrically oriented with respect to the figures described hitherto, thus realizing a symmetrical arrangement for all the components in the mechanism. In practice, the materials and measurements used can be whatever particular needs require.

I claim:

1. A mechanism for adjusting a chair back relative to the seat of a chair having a seat, a back and a support member interconnecting the seat and the back, comprising:

a series of spaced teeth provided on the support member;

an engagement member movably mounted to the back and including one or more engagement surfaces, the engagement member being movable between an engagement position in which the engagement surfaces are engaged with the teeth to prevent downward movement of the back relative to the support member, and a disengaged position in which the engagement surfaces are moved out of engagement with the teeth;

disengagement structure provided on the support member, the disengagement structure engaging the engagement member so as to move the engagement member away from its engagement position to allow upward movement of the back relative to the support member;

bias means mounted to the back and engageable with the engagement member upon upward movement of the back relative to the support member for urging the engagement member toward its engagement position;

an actuator structure provided on the support member and engageable with the engagement member upon movement of the back to a predetermined upper position relative to the support member, the actuator structure functioning to engage the engagement member with the bias means in a manner maintaining the engagement member in its disengaged position; and a release structure provided on the support member and engageable with the engagement member when the back is moved to a predetermined lowered position relative to the support member for disengaging the engagement member from the bias means for returning the engagement member and bias means to the position in which the bias means urges the engagement member toward its engaged position in response to upward movement of the back relative to the support member.

2. The mechanism of claim 1, wherein the teeth are formed on a rack secured to the support member, and wherein the actuator structure is formed on the rack above the teeth and wherein the release structure is formed on the rack below the teeth.

3. The mechanism of claim 2, wherein the support member includes a recess, and wherein the rack is positioned within the recess and wherein the engagement member is located within the recess adjacent the rack.

4. The mechanism of claim 1, wherein the engagement member is interconnected with the back so as to be pivotable about a pivot axis, and wherein each of the one or more engagement surfaces are formed on the engagement member so as to be laterally and vertically offset from the pivot axis.

5. The mechanism of claim 4, wherein the bias means comprises a resilient member secured to the back and having an end portion engageable with a retaining surface formed on the engagement member for urging the engagement member towards its engagement position in response to upward movement of the back relative to the support member.

6. The mechanism of claim 5, wherein the end portion of the bias member and the engagement member include mating engagement structure which maintains the engagement member in its disengaged position upon movement thereto by the actuator structure.

7. The mechanism of claim 1, wherein the teeth and the engagement member adjacent the engagement surfaces define the disengagement structure, which functions to move the engagement member to its disengaged position upon upward movement of the engagement member caused by upward movement of the back relative to the support member.

8. The mechanism of claim 2, wherein the disengagement structure comprises upwardly angled surfaces provided adjacent the engagement surfaces and on each of the teeth.

9. An adjustment mechanism for a seating assembly having a seat, a back and a support member including an upright portion, comprising:

a recess formed in the upright portion of the support member;

a rack member, separate from the support member, positioned within the recess and mounted to the support member;

a box-like unit securable to the back, the box-like unit defining a passage within which the support member upright portion including the recess is received, the recess being defined by side edges which are placed in close proximity to side edges of the support member upright portion for guiding movement of the back on the support member;

an engagement member interconnected with the box-like unit and positioned within the upright portion recess, the engagement member including engagement structure;

wherein the rack member includes a series of engagement surfaces engageable by the engagement structure of the engagement member for selectively preventing movement of the back relative to the support member in a first predetermined direction; and a biasing element for urging the engagement member to a position in which the engagement structure is engageable with the engagement surfaces and for enabling the engagement member to be moved to a position in which the engagement structure is disengaged from the engagement surfaces for providing adjustability in the position of the back relative to the support member.

10. A mechanism for adjusting a chair back relative to the seat of a chair having a seat, a back and a support member interconnecting the seat and the back, comprising:

a series of spaced teeth provided on the support member;

an engagement member movably mounted to the back and including one or more engagement surfaces, the engagement member being movable between an engagement position in which the engagement surfaces are engaged with the teeth to fix the position of the back relative to the support member and a disengaged position in which the engagement surfaces are moved out of engagement with the teeth, wherein the engagement member is interconnected with the back so as to be pivotable about a pivot axis, and wherein the engagement surfaces are formed on the engagement member so as to be laterally and vertically offset from the pivot axis;

disengagement structure on the engagement member for moving the engagement member to its disengaged position upon upward movement of the back relative to the support member;

bias means for engaging the engagement member upon movement to its disengaged position for urging the engagement member toward its engagement position, the bias means comprising:

a resilient member secured to the back and having an end portion engageable with a retaining surface formed on the engagement member for urging the engagement member towards its engagement position, the end portion of the bias member and the engagement member include mating engagement structure which maintains the engagement member in its disengaged position upon movement thereto by the actuator structure, wherein the mating engagement structure includes a protrusion formed toward the end portion of the bias member which is receivable within a notch formed in the engagement member for maintaining the engagement member in its disengaged position, and wherein the release structure functions to move the engagement member so as to disengage the protrusion from the notch in the engagement member;

actuator structure for engaging the engagement member upon movement of the back to a predetermined position relative to the support member, the actuator structure functioning to engage the engagement member with the bias means in a manner maintaining the engagement member in its disengaged position; and release structure for engaging the engagement member when the back is moved to a second predetermined position relative to the support member for disengaging the engagement member from the bias means for returning the engagement member and bias means to the position in which the bias means urges the engagement member toward its engaged position.

11. The mechanism of claim 10, wherein the teeth are formed on a rack secured to the support member, and wherein the actuator structure is formed on the rack above the teeth and wherein the release structure is formed on the rack below the teeth.

12. The mechanism of claim 11, wherein the support member includes a recess, and wherein the rack is positioned within the recess and wherein the engagement member is located within the recess adjacent the rack.

13. The mechanism of claim 10, wherein the bias member comprises a resilient L-shaped member, wherein the protrusion is formed toward the end of one of the legs of the L-shaped member and wherein the other leg of the L-shaped member is mounted to the back by being received within spaces defined between peg structure associated with the back.

14. The mechanism of claim 10, wherein the disengagement structure comprises upwardly angled surfaces provided adjacent the engagement surfaces and on each of the teeth.

15. A mechanism for adjusting a chair back relative to the seat of a chair having a seat, a back and a support member interconnecting the seat and the back, comprising:

a series of spaced teeth provided on the support member;

an engagement member movably mounted to the back and including one or more engagement surfaces, the engagement member being movable between an engagement position in which the engagement surfaces are engaged with the teeth to fix the position of the back relative to the support member and a disengaged position in which the engagement surfaces are moved out of engagement with the teeth;

disengagement structure on the engagement member for moving the engagement member to its disengaged position upon upward movement of the back relative to the support member;

bias means for engaging the engagement member upon movement to its disengaged position for urging the engagement member toward its engagement position;

actuator structure for engaging the engagement member upon movement of the back to a predetermined position relative to the support member, the actuator structure functioning to engage the engagement member with the bias means in a manner maintaining the engagement member in its disengaged position; and release structure for engaging the engagement member when the back is moved to a second predetermined position relative to the support member for disengaging the engagement member from the bias means for returning the engagement member and the bias means to a position in which the bias means urges the engagement member toward its engaged position;

wherein the support member defines a pair of side edges and a recess within which the teeth are disposed, and wherein the back includes a box unit through which the support member extends, wherein the engagement member and bias means are located within the box unit and within the support member recess.

16. The mechanism of claim 15, wherein the box unit defines a pair of spaced edges, and wherein one of the side edges of the support member is disposed adjacent each edge of the box unit, and further comprising one or more friction members mounted to the box unit adjacent one of its edges and engageable with one of the side edges of the support member for controlling movement of the box unit, and thereby the back, relative to the support member.

17. The mechanism of claim 16, wherein the box unit includes a cleat member secured to the back, and a bracket member mounted to the cleat member, the bracket member including structure defining the pair of spaced side edges of the box unit.

* * * * *